US010194734B2

(12) United States Patent
DiJulio, Jr.

(10) Patent No.: US 10,194,734 B2
(45) Date of Patent: Feb. 5, 2019

(54) INTEGRATED CARRYING STRAP

(71) Applicant: Chris DiJulio, Jr., Kirkland, WA (US)

(72) Inventor: Chris DiJulio, Jr., Kirkland, WA (US)

( * ) Notice: Subject to any disclaimer, the term of this patent is extended or adjusted under 35 U.S.C. 154(b) by 0 days.

(21) Appl. No.: 15/588,370

(22) Filed: May 5, 2017

(65) Prior Publication Data

US 2018/0042371 A1 Feb. 15, 2018

Related U.S. Application Data

(60) Provisional application No. 62/372,874, filed on Aug. 10, 2016.

(51) Int. Cl.
*A45F 5/10* (2006.01)
*A45F 5/00* (2006.01)

(52) U.S. Cl.
CPC ..... *A45F 5/10* (2013.01); *A45F 5/00* (2013.01); *A45F 2005/006* (2013.01); *A45F 2005/008* (2013.01); *A45F 2005/1006* (2013.01); *A45F 2005/1013* (2013.01); *A45F 2200/0583* (2013.01)

(58) Field of Classification Search
CPC ..... A45F 5/10; B65D 23/10; B65D 23/108; B65D 23/104; B65D 25/2876; B65D 25/2873; B65D 25/2867; B65D 25/2835; B65D 25/28
USPC ..... 215/397, 396, 395; 220/754, 756, 758, 220/759; 16/425, 422, 444; 224/148.6
See application file for complete search history.

(56) References Cited

U.S. PATENT DOCUMENTS 1,806,479 A * 5/1931 Lory ..... A47G 23/0216 215/306
4,627,546 A * 12/1986 Carranza ..... B65D 23/106 215/396

(Continued)

FOREIGN PATENT DOCUMENTS

GB 1124705 A * 8/1968 ..... A45C 13/26
WO 2014/060930 A2 4/2014

OTHER PUBLICATIONS

"Festive Coca-Cola Bottle Label Ties Into a Holiday Bow," Coca-Cola Journey™ (digital magazine), Dec. 10, 2015, <http://www.coca-colacompany.com/coca-cola-unbottled/festive-coca-cola-bottle-label-ties-into-a-holiday-bow>, 3 pages.

(Continued)

*Primary Examiner* — Robert J Hicks
(74) *Attorney, Agent, or Firm* — Christensen O'Connor Johnson Kindness PLLC

(57) ABSTRACT

The carrying straps and carrying loops described herein are generally suitable for use with a container various containers. The carrying straps and loops include first and second attachment portions for securement to various locations on the container. In one example, a carrying strap has a stowed position, where the strap wraps around the container, to a carrying position, where the strap secures to a second location on the container such that the strap can be used to carry the container. In another example, a carrying loop has a deployed position, where the loop secures to only a first location on the container and is used to carry the container. The carrying straps and loops are suitably positioned as covering a label of the container, as a replacement for the label, or placed in any different position on the container from the label.

13 Claims, 10 Drawing Sheets

(56) References Cited

U.S. PATENT DOCUMENTS

| | | | | |
|---|---|---|---|---|
| 4,724,971 | A * | 2/1988 | Henline | B65D 23/106 16/111.1 |
| 5,967,560 | A | 10/1999 | Seidl | |
| 2006/0255006 | A1 | 11/2006 | Wagenknecht et al. | |
| 2010/0072234 | A1 * | 3/2010 | Tymczyna | A45C 3/001 224/148.6 |

OTHER PUBLICATIONS

International Search Report dated Nov. 9, 2017, issued in corresponding International Application No. PCT/US2017/046097, filed Aug. 9, 2017, 6 pages.

* cited by examiner

INTEGRATED CARRYING STRAP

CROSS-REFERENCE TO RELATED APPLICATION

This application claims the benefit of U.S. Provisional Application No. 62/372,874, filed Aug. 10, 2016, the entire disclosure of which is hereby incorporated by reference herein for all purposes.

BACKGROUND

In addition to the primary function of containing a liquid, food, or other contents, manufactures of containers integrate features into the body of the container to enhance the effectiveness of the grip by the hand of a user such that the container can be more securely carried. In some designs, the containers include indentations, texture, or other grip enhancing features. However, the container generally requires the user to devote the use of the hand to carry the container.

The need for secure grip of a container is further amplified as activity increases, for example, during exercise or other activities where a container can dislodge from the hand of the user. In this regard, while participating in activities where further assistance in gripping a container is desired, or when the hand of the user is required for other tasks, the features described above may be supplemented to provide further carrying assistance with the container such that the container can be secured to the body of the user or another object.

Conventional carrying assist devices used with containers of different types are typically sold separately from the container itself. In one example, a disposable water bottle may have various separate options for enhanced carrying, such as a wearable pocket, a strap attached to the bottle, an encapsulating shell, or the like. Many of the above examples require the purchase and installation of a separate apparatus to take advantage of the enhanced gripping functionality. In another example, larger containers may include handles as a portion of the container; however, in smaller containers, space constraints typically prevent the integration of a handle, especially in personal, single-serving containers used during exercise or other daily activities.

Therefore, a need exists for an apparatus configured to assist in the carrying or securing of a container, where the apparatus is suitable for integration into the container as it is sold and is optionally disposable or recyclable after use.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In accordance with one embodiment of the present disclosure, a carrying strap for a container is provided. The carrying strap for a container generally includes an elongate web having a distal end and a proximal end. The elongate web generally includes a first attachment portion near the distal end and coupled to a first location on the container; a second attachment portion located near the proximal end and removably coupled to a second location on the container when the carrying strap is in a stowed position; and a securement aperture near the proximal end configured to receive a top portion of the container when the carrying strap is in a carrying position.

In accordance with another embodiment of the present disclosure, a carrying loop for a container is provided. The carrying loop for a container generally includes a first elongate web having a distal end and a proximal end; a second elongate web having a distal end and a proximal end, wherein the proximal end of the second elongate web extends from the proximal end of the first elongate web; a first attachment portion located near the distal ends of the first and second elongate webs, the first attachment portion coupled to a first location on the container; and a second attachment portion located near the proximal ends of the first and second elongate webs, the second attachment portion removably coupled to a second location on the container when the carrying loop is in a stowed position.

In accordance with another embodiment of the present disclosure, a container having a carrying assembly is provided. The container having a carrying assembly generally includes a container body having a top portion; and a carrying strap. The carrying strap generally includes a first elongate web having distal end and a proximal end; a first attachment portion near the distal end and coupled to a first location on the container body; a second attachment portion located near the proximal end and removably coupled to a second location on the container body when the carrying strap is in a stowed position; and a securement aperture near the proximal end configured to receive the top portion of the container body when the carrying strap is in a carrying position.

In accordance with any of the embodiments described herein, the first attachment portion may be coupled to the first location on the container using one of adhesive, co-molding, friction welding, interlocking features, and any combination thereof.

In accordance with any of the embodiments described herein, the second attachment portion may be removably coupled to the second location on the container using one of adhesive, interlocking features, and any combination thereof.

In accordance with any of the embodiments described herein, the carrying strap may be transparent such that the carrying strap does not obscure a label of the container in the stowed position.

In accordance with any of the embodiments described herein, the elongate web may include a surface design, coloring, logo, advertising information, graphic, Trademark, message, direction set, warning, ingredient list, game, bar code, Universal Product Code, Quick Response Code, and any combination thereof.

In accordance with any of the embodiments described herein, the carrying strap may comprise a material selected from the group consisting of plastic, vinyl, metal, fabric, synthetic fiber, rubber, and any combination thereof.

In accordance with any of the embodiments described herein, the securement aperture may be a shape selected from a group consisting of a slit, an X-shape, an asterisk, an arcuate line, a C-shape, a circle with relief cuts, a triangle, and any combination thereof.

In accordance with any of the embodiments described herein, the carrying loop may surround a neck portion of the container when the carrying loop is in a carrying position.

In accordance with any of the embodiments described herein, one or both of the first and second elongate webs may include a surface design, coloring, logo, advertising information, graphic, Trademark, message, direction set, warning, ingredient list, game, bar code, Universal Product Code, Quick Response Code, and any combination thereof.

In accordance with any of the embodiments described herein, the carrying strap may further include a second elongate web having a distal end and a proximal end, wherein the proximal end of the second elongate web extends from the proximal end of the first elongate web.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
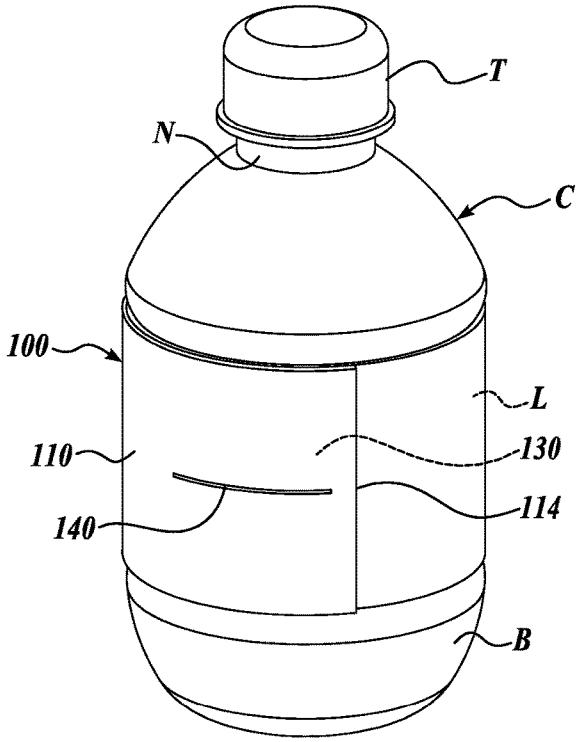
FIG. 1 is a top front perspective view of one representative embodiment of an integrated carrying strap in accordance with an aspect of the present disclosure, showing the integrated carrying strap in a stowed position.

The detailed description set forth below in connection with the appended drawings, where like numerals reference like elements, are intended as a description of various embodiments of the present disclosure and are not intended to represent the only embodiments. Each embodiment described in this disclosure is provided merely as an example or illustration and should not be construed as precluding other embodiments. The illustrative examples provided herein are not intended to be exhaustive or to limit the disclosure to the precise forms disclosed. Similarly, any steps described herein are interchangeable with other steps, or combinations of steps, in order to achieve the same or substantially similar result.

In the following description, specific details are set forth to provide a thorough understanding of exemplary embodiments of the present disclosure. It will be apparent to one skilled in the art, however, that the embodiments disclosed herein may be practiced without embodying all of the specific details. In some instances, well-known process steps have not been described in detail in order not to unnecessarily obscure various aspects of the present disclosure. Further, it will be appreciated that embodiments of the present disclosure may employ any combination of features described herein.

The present application may include references to directions, such as "forward," "rearward," "front," "rear," "upward," "downward," "top," "bottom," "right hand," "left hand," "lateral," "medial," "in," "out," "extended," etc. These references, and other similar references in the present application, are only to assist in helping describe and to understand the particular embodiment and are not intended to limit the present disclosure to these directions or locations.

The present application may also reference quantities and numbers. Unless specifically stated, such quantities and numbers are not to be considered restrictive, but exemplary of the possible quantities or numbers associated with the present application. Also in this regard, the present application may use the term "plurality" to reference a quantity or number.

The following description provides several examples that relate to integrated carrying straps. Embodiments of the present disclosure are generally directed to carrying straps used in conjunction with containers to aid in the carrying and securement of the container. The containers illustrated in the FIGURES are generally shown as liquid containers, such as those used for drinks, e.g., water, soda, juice, sports drinks, and the like. However, in other embodiments, the containers used in conjunction with the integrated carrying straps of the present disclosure are suitably any type of container, such as a solid food container (e.g., a compartmentalized food container), a carton, a bag, a pouch, glassware, and the like. Likewise, the contents of the container may be liquid, solid, powder, or any other suitable content.

An integrated carrying strap constructed in accordance with one embodiment of the present disclosure is provided. Referring to FIGS. 1-4, an integrated carrying strap 100 is shown coupled to a container C, represented in one example as a plastic bottle containing liquid. In the illustrated example, the water bottle C includes a top lid portion T (e.g. a threaded cap), a neck portion N, a label L, and a base B. In examples where the integrated carrying strap 100 is coupled to a bottle C configured for containing liquid, the integrated carrying strap 100 may be suitably coupled to different locations along the height of the bottle C, as explained in greater detail below. In this regard, a comparison of FIGS. 1-4 and FIGS. 5-12 show a portion of embodiments of various mounting locations. In other embodiments, the integrated carrying strap 100 is coupled to any suitable location along the height of the bottle C. Likewise, in further embodiments, the integrated carrying strap 100 may surround only a portion of the bottle C when stowed, such as when the carrying strap is folded. Although the carrying straps 100 are depicted as placed in a generally level configuration around the bottle C when stowed, in other embodiments, the carrying strap 100 may be at any suitable orientation relative to the bottle C.

In some embodiments, the integrated carrying strap 100 is manufactured from a transparent material such that the strap 100 can be integrated to the container C in a position where the strap covers the label L without obscuring the label. See, e.g., FIG. 1. In this regard, the carrying strap 100 is suitably integrated into a container C without altering the appearance, functionality, Trademarks, warnings, or marketing opportunities displayed on the label L of the container C. In other embodiments, the integrated carrying strap 100 itself is suitably manufactured with an integrated or attached label; surface design; coloring; logo; advertising information; graphic; Trademark; message; direction set; warning, ingredient list; game; and/or a readable code, such as a bar code, Universal Product Code (UPC), Quick Response (QR) Code, etc. In these embodiments, the integrated carrying strap 100 suitably replaces the label L of the bottle C, or adds additional content to the bottle C. In other embodiments, the foregoing designs can be hidden from view such that deploying the integrated carrying strap 100 reveals the design. The foregoing surface designs are suitably located on either side or both sides of the carrying strap 100 such that the surface designs are visible or hidden in a stowed position.

Figure 2:
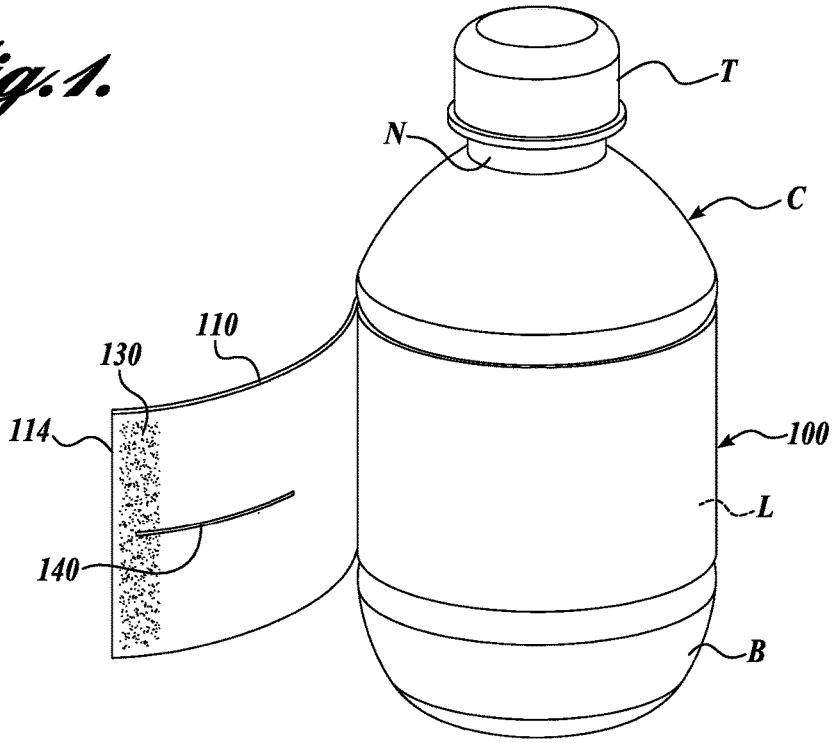
FIG. 2 is a top front perspective view of the integrated carrying strap of FIG. 1, showing the integrated carrying strap in a partially stowed position.
Figure 3:
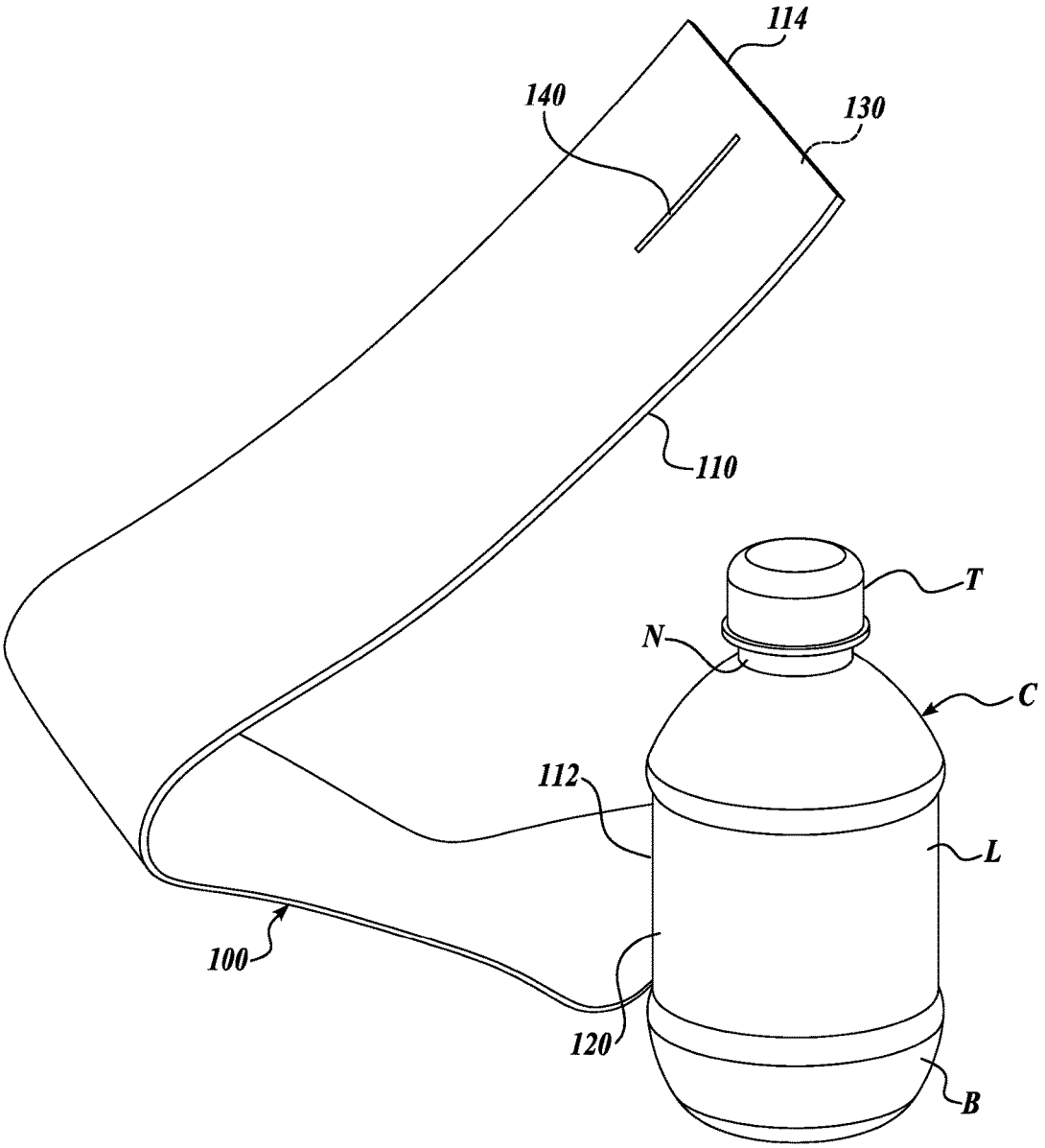
FIG. 3 is a top front perspective view of the integrated carrying strap of FIG. 1, showing the integrated carrying strap in a deployed position.

As shown most clearly in FIG. 3, an embodiment of the deployed integrated carrying strap 100 generally includes an elongate web body 110, a first attachment portion 120 on a distal end 112 of the elongate web body 110, a second attachment portion 130 (opposite side from view) on a proximal end 114 of the elongate web body 110, and a securement aperture 140 near the proximal end 114. The elongate web body 110 of the embodiment shown in FIGS. 1-4 will now be described in greater detail.

The elongate web body 110 of the integrated carrying strap 100 is generally of a dimension in length, width, and thickness suitable for use with the container C on which the carrying strap 100 is integrated. In the example depicted in FIGS. 1-4, the elongate web body 110 is of a length such that the elongate web body 110 is capable of wrapping around the container C twice. However, in other embodiments, fewer or more revolutions than two is within the scope of the present disclosure, including partial revolutions. In general, the length of the elongate web body 110 is likewise dependent upon the distance the elongate web body 110 must span to reach a coupling point for the securement aperture for the proximal end 114 of the integrated carrying strap 100, as will be described in greater detail below. In a similar manner, the elongate web portion 110 has a width such that it covers a suitable portion of the container C; is comfortable to carry; has optimal weight, cost, material usage, and strength; or a combination of the foregoing attributes. Likewise, the elongate web portion 110 has a suitable thickness to provide similar attributes.

The integrated carrying strap 100 is suitably manufactured from material that combines suitable design aspects of weight, cost, strength, and compatibility with the container C. In this regard, the integrated carrying strap 100 may be manufactured from plastic, vinyl, metal, fabric, synthetic fiber, rubber, or any other suitable material. In some embodiments, the integrated carrying strap 100 is flexible such that it is capable of conforming to the shape of the container and the shape of an interacting object, such as a user's hand. In further embodiments, the material is selected such that surface treatments are capable of application, as described above.

As shown in FIG. 3, in some embodiments, the integrated carrying strap 100 has the first attachment portion 120 to the container C at the distal end 112 of the elongate web body 110. The coupling of the elongate web body 110 to the container C at the first attachment portion 120 is suitably accomplished with one of adhesive, co-molding, friction welding, interlocking features, and any combination thereof. In some embodiments, the first attachment portion 120 is intended to be permanent or semi-permanent, such that the attachment does not detach during use, and is not detachable by the user during normal use. In this regard, the first attachment portion 120 is secured during manufacturing of the container C, or by an assembler, for example, when adding logos or marketing to an existing container C, as explained in further detail below. In other embodiments, the first attachment portion 120 is detachable by the user for securement to other locations of the container C.

As shown in FIG. 2, in some embodiments, the integrated carrying strap 100 has the second attachment portion 130 to the container C near the proximal end 114 of the elongate web body 110. The second attachment portion 130 provides the ability to stow the integrated carrying strap 100 when not in use, during display, or during transportation of a new container C for retail. The second attachment portion 130 is intended to be non-permanent such that the proximal end 114 can be detached during use to place the proximal end 114 at a different location on the container C. The second attachment portion 130 is suitably accomplished by one of adhesive, interlocking features, perforated connection, magnets, and any combination thereof. In some embodiments, the second attachment portion 130 is secured during manufacturing of the container C, or by an assembler, but can readily be decoupled and recoupled for various uses by the user.

In the illustrated embodiment of FIGS. 1-4, the proximal end 114 also includes the securement aperture 140 for securing the proximal end 114 to a second location on the container C. In one example shown most clearly in FIGS. 3-4, the securement aperture 140 is a linear slit aligned with the length of the elongate web body 110. In some embodiments, the top portion T of the container C can be inserted through the securement aperture 140 such that the elongate web body 110 interfaces the neck portion N and provides a second securement location to place the integrated carrying strap 100 in a carrying position. See, e.g., FIG. 4.

In embodiments where the securement aperture 140 is configured to surround the neck portion N to place the integrated carrying strap 100 in the carrying position, the securement aperture 140 has a suitable length such that the top portion T can be inserted through the securement aperture 140. Turning now to FIGS. 13-18, in practice, ease of use and securement considerations may determine the shape of the securement aperture 140, such as various shapes, including a different orientation of the linear slit 142 (FIG. 13), an X-shape 144 (FIG. 14), an asterisk 146 (FIG. 15), circular shapes with relief cuts 148 and 150 (FIGS. 16 and 17), a triangle 152 (FIG. 18), an arcuate line (not shown), a C-shape (not shown), or any other suitable aperture shape or combination. In this regard, the securement aperture 140 is shaped to readily allow installation over the top portion T to the neck portion N, but provide securement such that the proximal end 114 does not slip off the neck portion N during use of the integrated carrying strap 100. In other embodiments, the securement aperture 140 is perforated (not shown) such that the perforations are severed during the first insertion of the top portion T through the securement aperture 140. In further embodiments, various other locations of the container C are suitable for attachment of the securement aperture 140, such as the base B or the top lid portion T.

Figure 4:
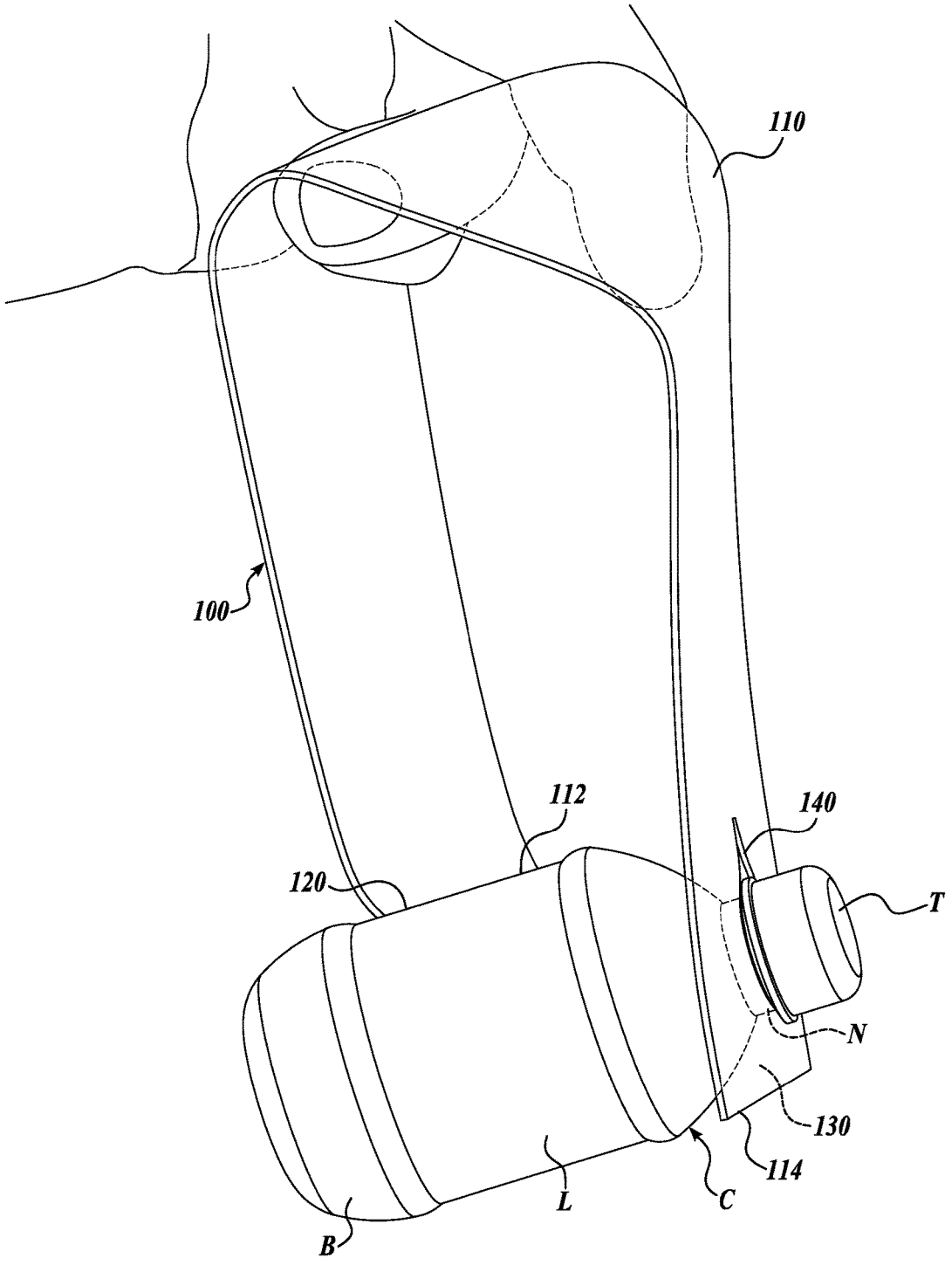
FIG. 4 is an environmental perspective view of the integrated carrying strap of FIG. 1, showing the integrated carrying strap in a carrying position.

As shown in FIG. 4, when the securement aperture 140 is installed to the neck portion N of the container C, the elongate web portion 110 forms a loop suitable for enhanced carrying of the container C by a user. In this regard, a wide variety of carrying configurations are within the scope of the present disclosure. An example of uses may include a hand strap, a shoulder strap, an equipment strap (e.g., to a backpack, bicycle, vehicle, clothing, etc.), or any other suitable configuration. In these embodiments, when the integrated carrying strap 100 is not in use, it can be wrapped around the container C and placed in the stowed position by recoupling of the second attachment portion 130. In some embodiments, the elongate web portion 110 includes an attached peripheral (not shown) for use with the container C. In one example, a flexible straw for use with the contents of the container C is attached to the elongate web portion 110. In other embodiments, any suitable peripheral is attached to the elongate web portion 110, such as stickers, tags, keychains, pouches, electronics, lights, etc.

Figure 5:
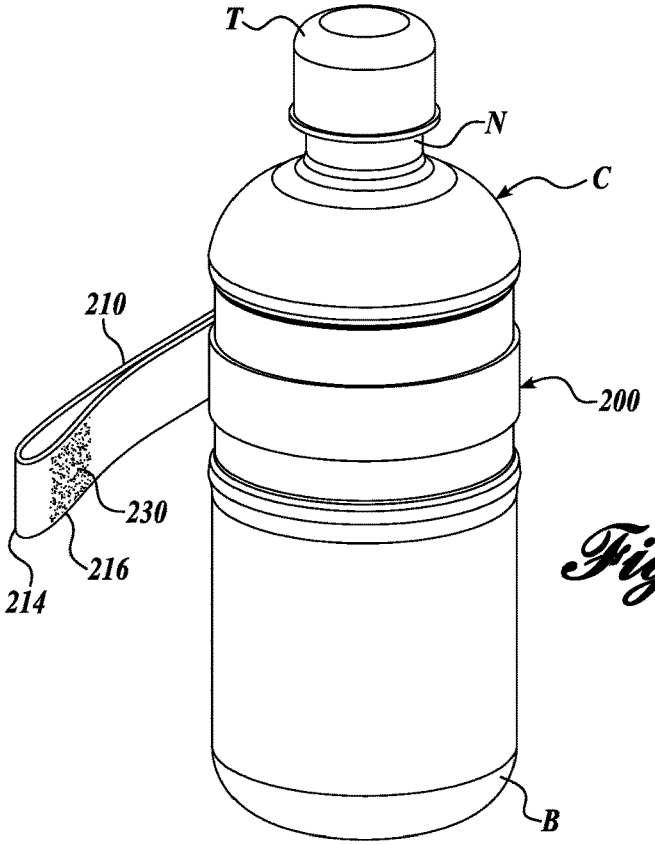
FIG. 5 is a top front perspective view of another representative embodiment of an integrated carrying strap in accordance with an aspect of the present disclosure, showing the integrated carrying strap in a partially stowed position.
Figure 6:
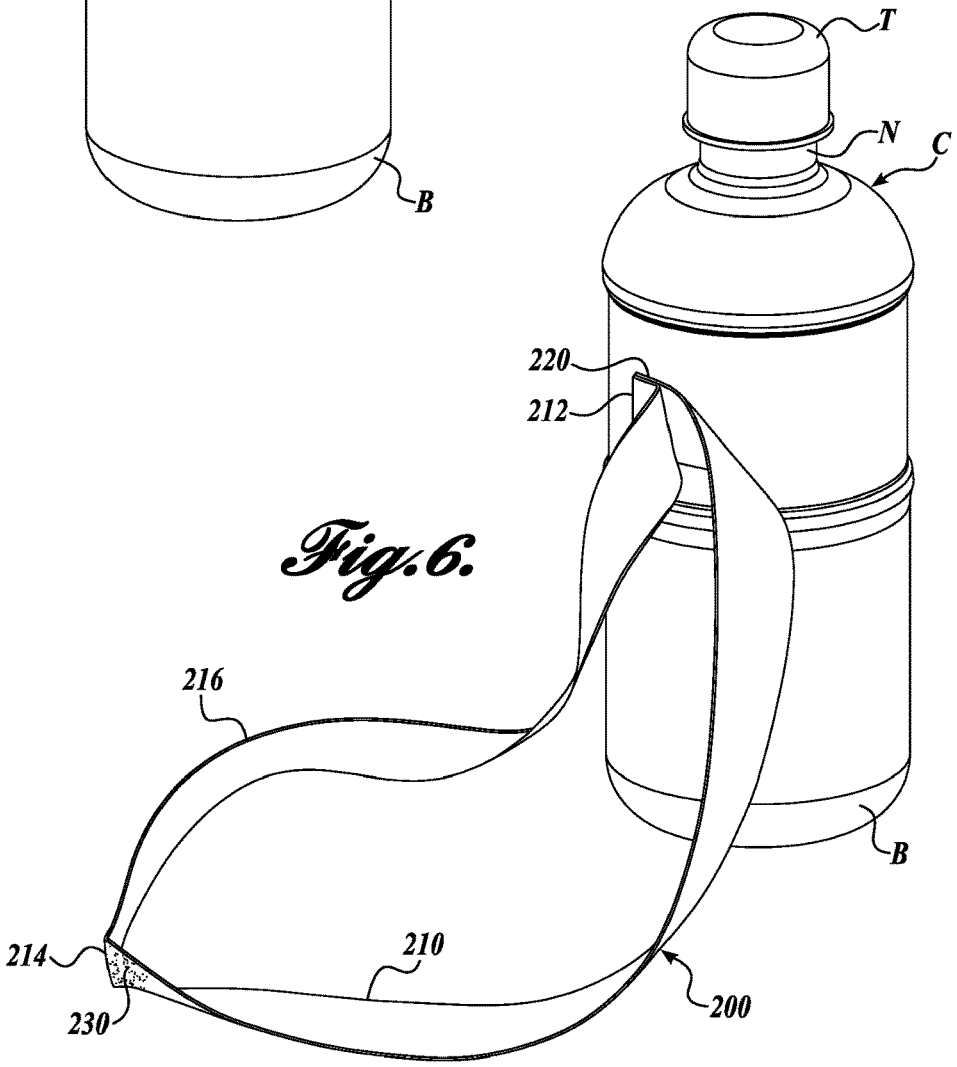
FIG. 6 is a top front perspective view of the integrated carrying strap of FIG. 5, showing the integrated carrying strap in a deployed position.
Figure 7:
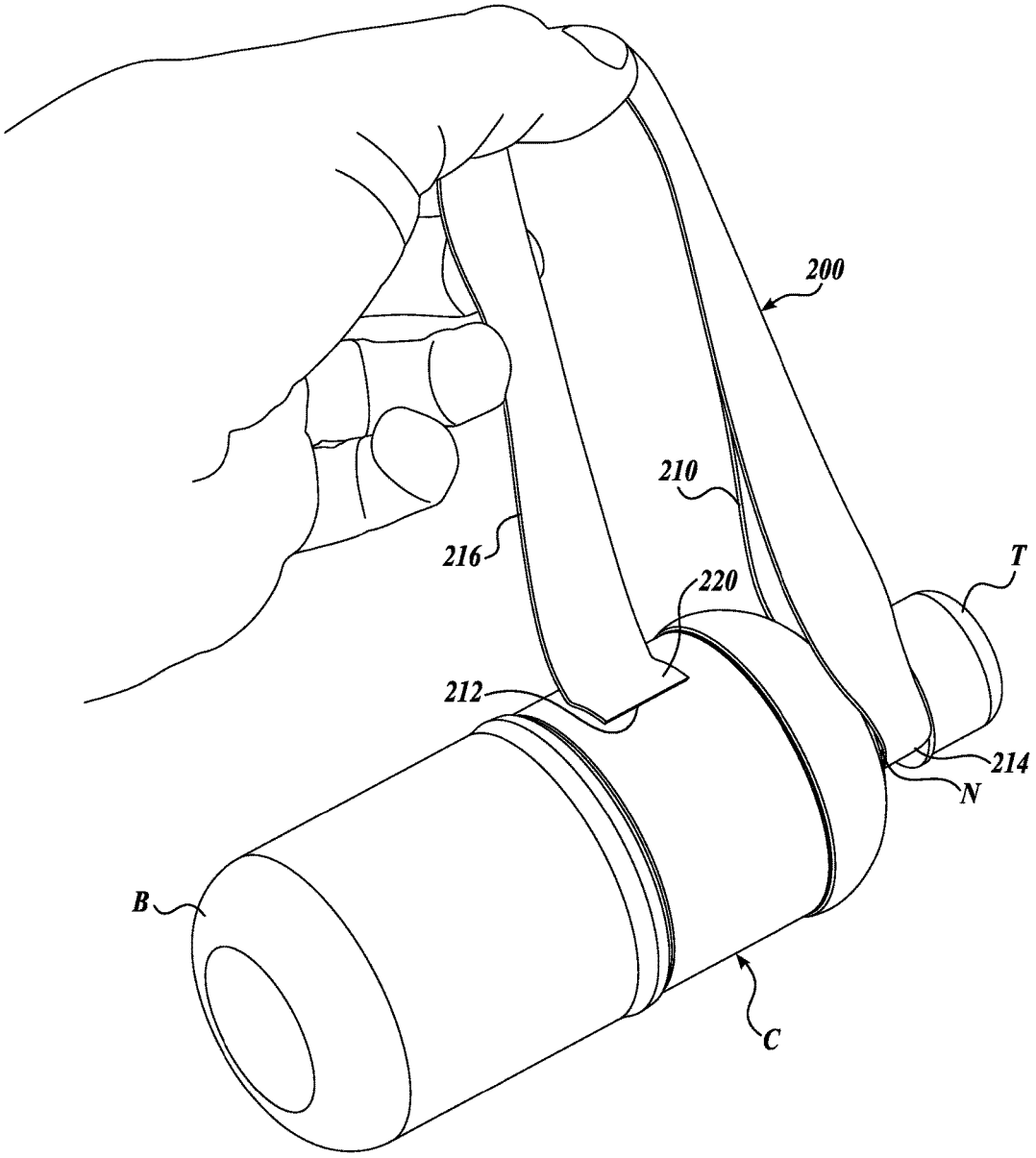
FIG. 7 is an environmental perspective view of the integrated carrying strap of FIG. 5, showing the integrated carrying strap in a carrying position.
Figure 8:
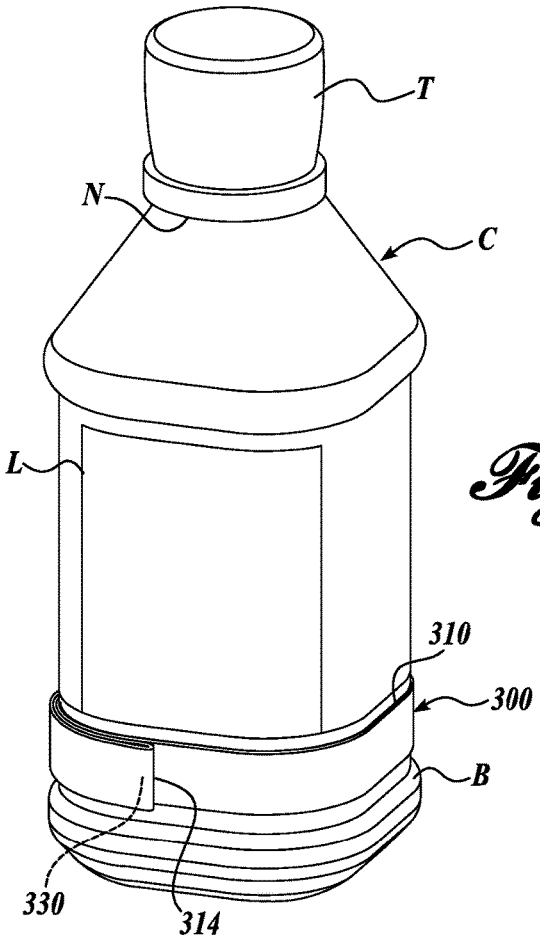
FIG. 8 is a top front perspective view of another representative embodiment of an integrated carrying strap in accordance with an aspect of the present disclosure, showing the integrated carrying strap in a stowed position.
Figure 9:
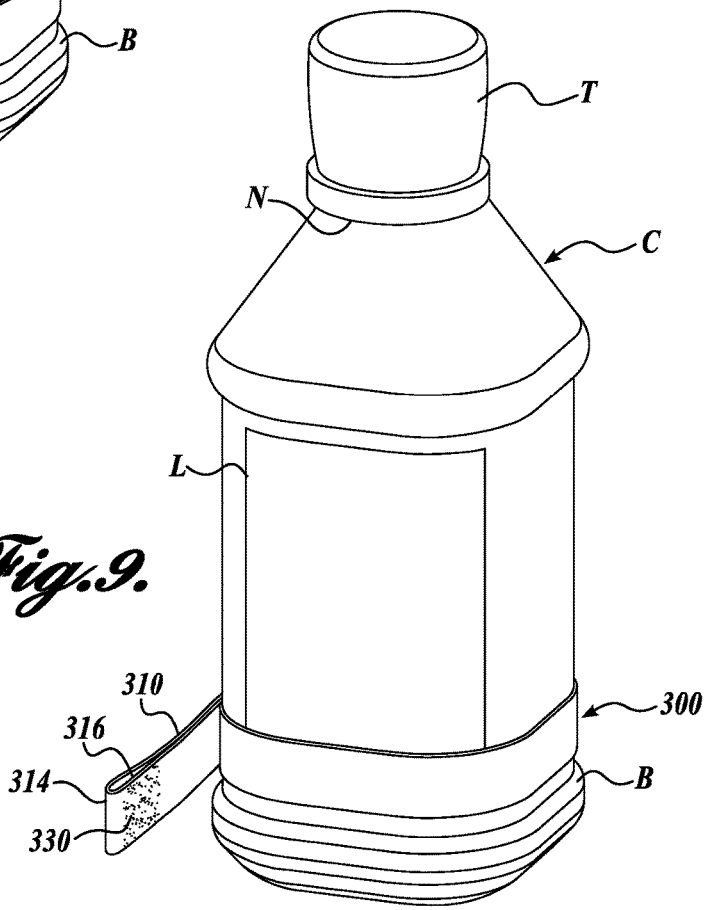
FIG. 9 is a top front perspective view of the integrated carrying strap of FIG. 8, showing the integrated carrying strap in a partially stowed position.
Figure 10:
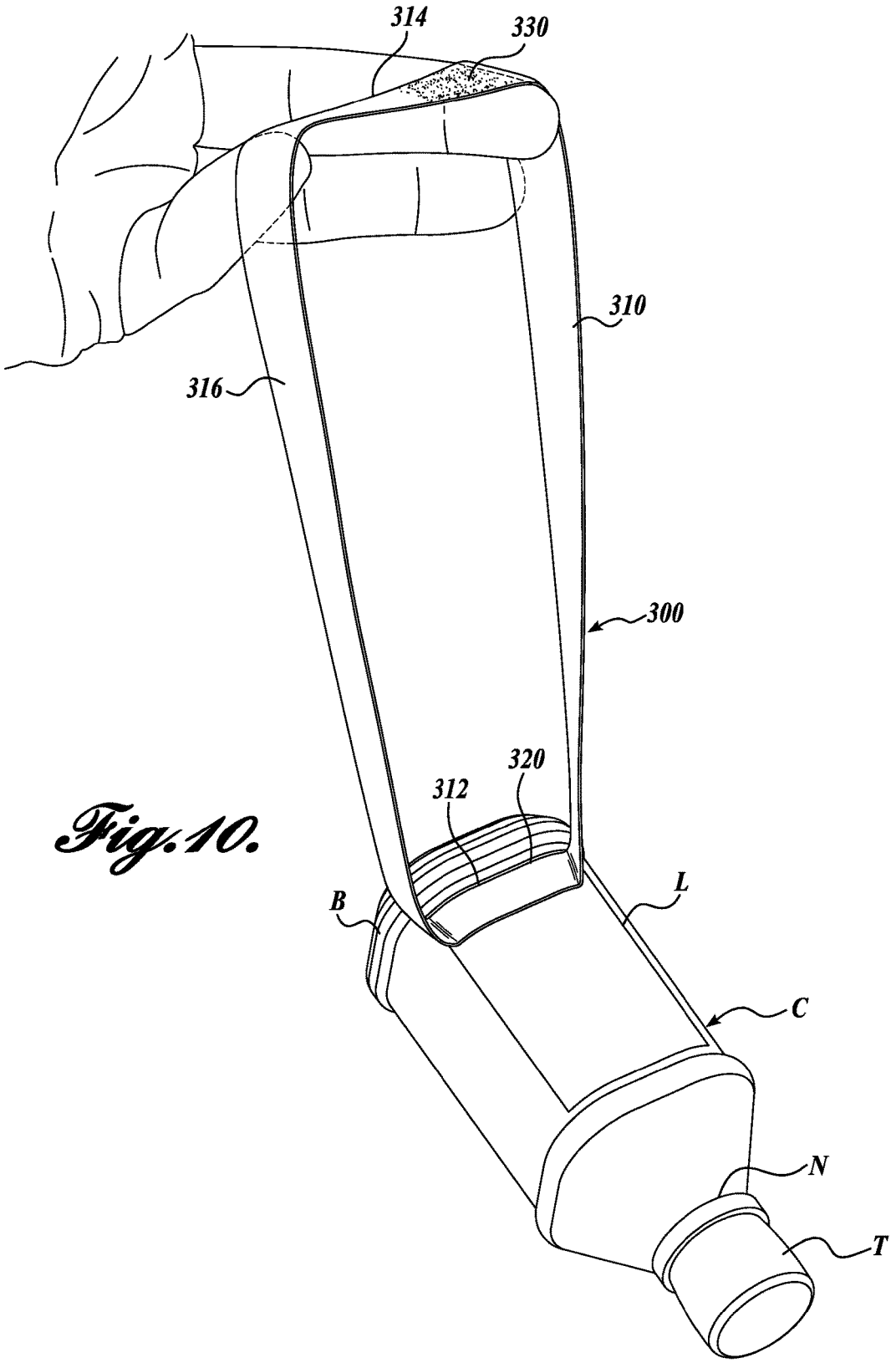
FIG. 10 is an environmental perspective view of the integrated carrying strap of FIG. 8, showing the integrated carrying strap in a deployed position.

Turning now to FIGS. 5-7, a further embodiment of an integrated carrying strap 200 is provided. The integrated carrying strap 200 is substantially similar to the integrated carrying strap 100 but is configured as a loop as explained in detail below. For brevity, the components similar to those of the integrated carrying strap 100 are in the 200-series. The integrated carrying strap 200 includes a first elongate web portion 210 and a second elongate web portion 216 extending from the proximal end 214 of the first elongate web portion 210 to form a loop. In general, the embodiments of the integrated carrying strap 200 include similar material options, surface designs, and peripherals as the integrated carrying strap 100. In some embodiments, the integrated carrying strap 200 similarly includes a securement aperture (not shown) through one or both of the first elongate web portion 210 and the second elongate web portion 216 such that additional carrying options are available to the user.

The integrated carrying strap 200 includes a first attachment portion 220 to couple the integrated carrying strap 200 to the container C at a distal end 212. In a similar manner to the integrated carrying strap 100, the proximal end 214 includes a second attachment portion 230 to stow the integrated carrying strap 200 when not in use. In the illustrated embodiment in FIG. 6, the integrated carrying strap 200 is suitable for use with only the first attachment point 220 coupled to the container C such that the container C may be carried by the loop of the integrated carrying strap 200 in any suitable configuration, such as by a hand, a purse, a backpack, a stroller, a keychain, etc. In this regard, the integrated carrying strap 200 forms a loop with the single attachment point; however, as explained below, the integrated carrying strap 200 is capable of a second attachment location on the container C.

In another carrying configuration, referring to FIG. 7, the integrated carrying strap 200 is shown with the proximal end 214 interfacing the neck portion N of the container C. In this regard, placing the loop of the integrated carrying strap 200 around the neck portion N provides a second attachment location on the container C for use as a carrying strap as shown.

Figure 11:
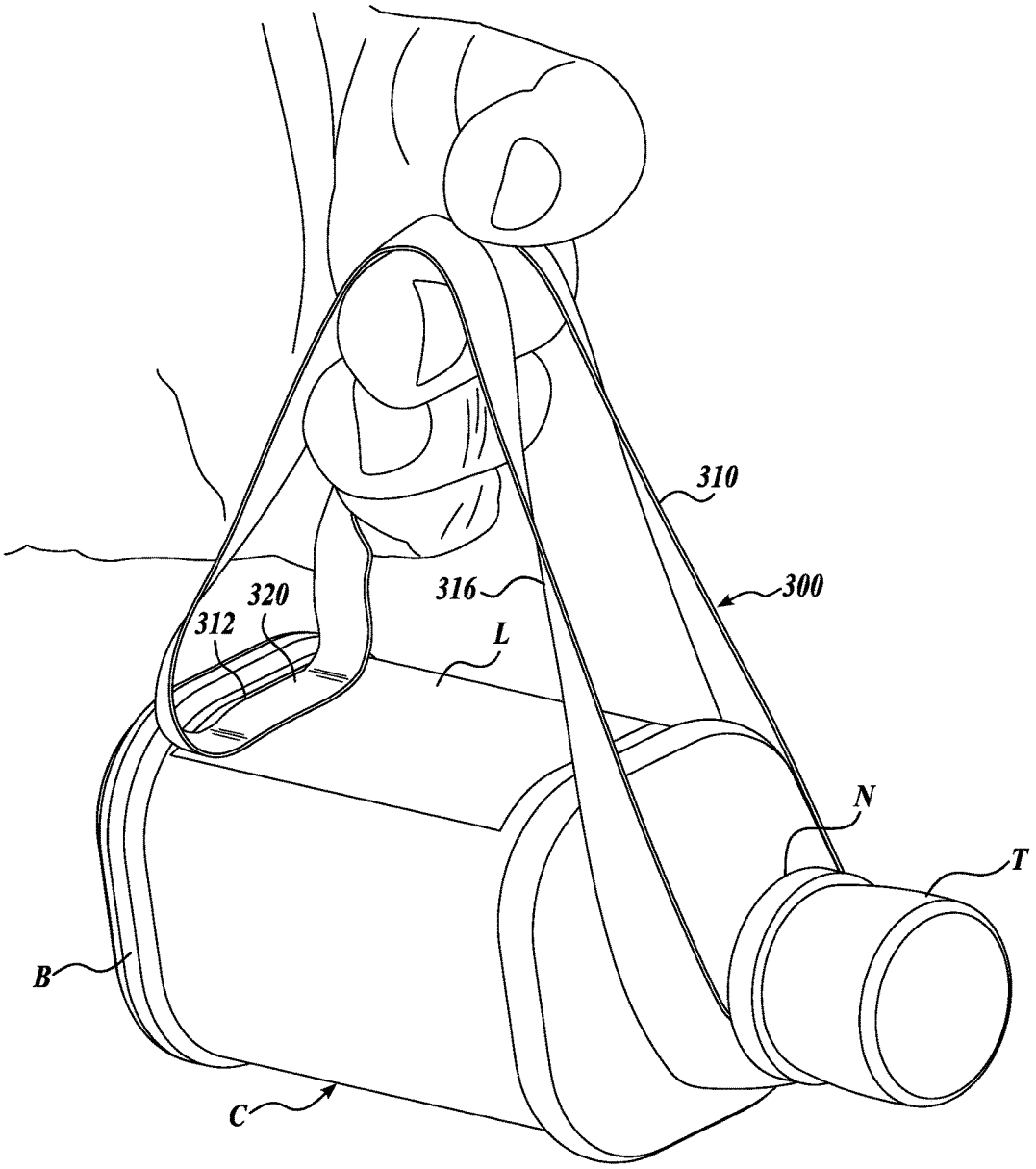
FIG. 11 is an environmental perspective view of the integrated carrying strap of FIG. 8, showing the integrated carrying strap in a carrying position.

Turning now to FIGS. 8-11, another embodiment of an integrated carrying strap 300 is provided. The integrated carrying strap 300 is substantially similar to the integrated carrying strap 200, but is attached to a different location of the container C near the base B. Further, in the illustrated embodiment, the integrated carrying strap 300 is attached to the container C along a larger area at a first attachment point 320 as shown most clearly in FIG. 10. Similar to the integrated carrying strap 200, the integrated carrying strap 300 is suitably used with a single attachment location at the first attachment point 320, or with multiple attachment points, such as a second attachment location around the neck portion N (FIG. 11).

Figure 12:
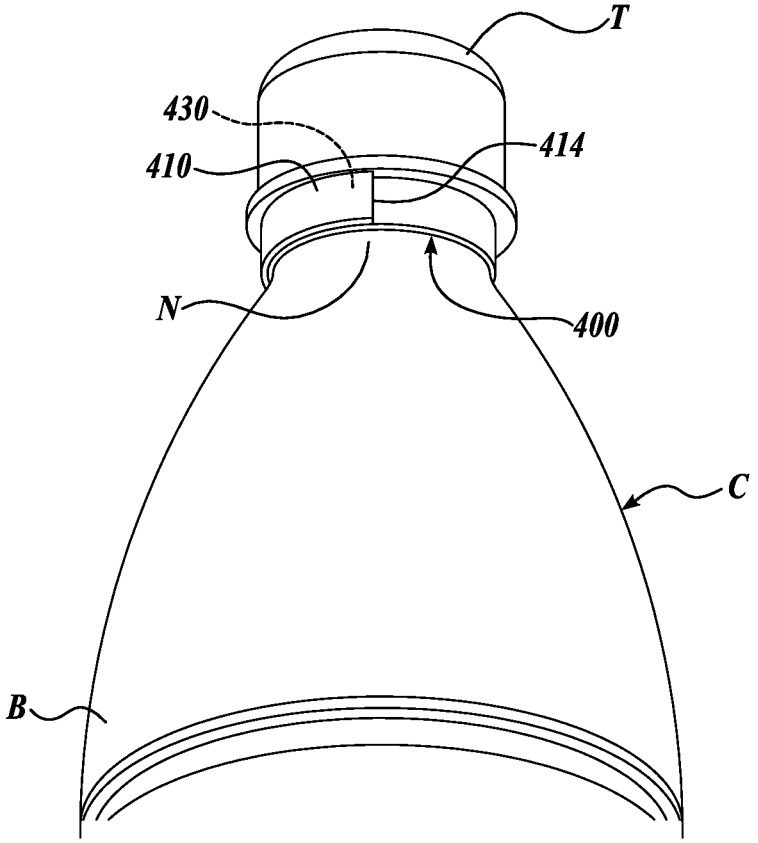
FIG. 12 is a top front perspective view of another representative embodiment of an integrated carrying strap in accordance with an aspect of the present disclosure, showing the integrated carrying strap in a stowed position.
Figure 13:
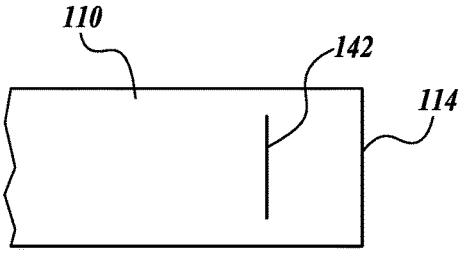
FIGS. 13-18 are plan views of other representative embodiments of integrated carrying straps in accordance with aspects of the present disclosure, showing various securement aperture configurations.
Figure 14:
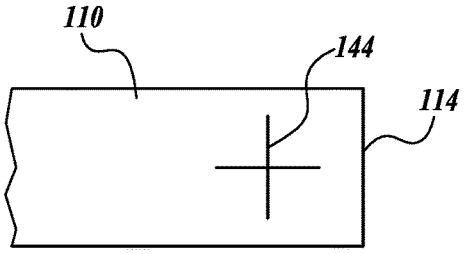
Figure 15:
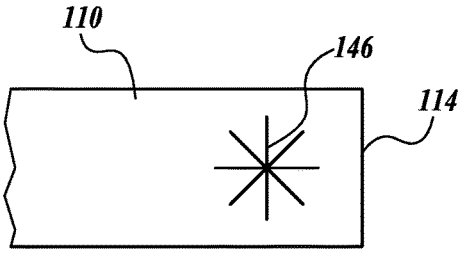
Figure 16:
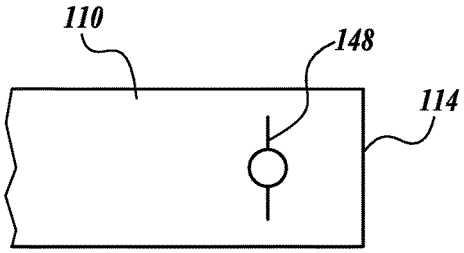
Figure 17:
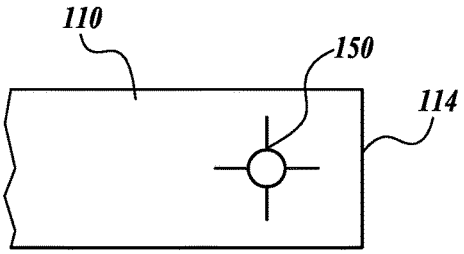
Figure 18:
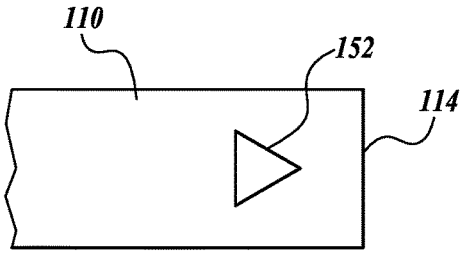

In another embodiment, as shown in FIG. 12, the integrated carrying strap 400 is substantially similar to the integrated carrying straps 100, 200, and 300, but is attached to a different location of the container C around the neck portion N. In some embodiments, the integrated carrying strap 400 includes a single elongate web portion 410 such that the integrated carrying strap 400 is used in configurations like the integrated carrying strap 100. However, in other embodiments, the integrated carrying strap 400 includes a second elongate web portion (not shown) such that the integrated carrying strap 400 forms a loop and is used in configurations like the integrated carrying straps 200 and 300.

The principles, representative embodiments, and modes of operation of the present disclosure have been described in the foregoing description. However, aspects of the present disclosure, which are intended to be protected, are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure as claimed.

The embodiments of the invention in which an exclusive property or privilege is claimed are defined as follows:

1. A carrying strap for a container, the carrying strap comprising:

an elongate web having a distal end and a proximal end, the elongate web comprising:

a first attachment portion near the distal end and couplable to a first location on the container;

a second attachment portion located near the proximal end and removably couplable to a second location when the carrying strap is in a stowed position; and a securement aperture near the proximal end configured to receive a top portion of the container when the carrying strap is in a carrying position, wherein, in the stowed position, a first section of the elongate web near the distal end is configured to circumferentially wrap around and continuously abut the container and a second section of the elongate web near the proximal end is configured to circumferentially overlap and abut the first section, and wherein the second location is on the elongate web.

2. The carrying strap of claim 1, wherein the first attachment portion is couplable to the first location on the container using one of adhesive, co-molding, friction welding, interlocking features, and any combination thereof.

3. The carrying strap of claim 1, wherein the second attachment portion is removably couplable to the second location on the container using one of adhesive, interlocking features, and any combination thereof.

4. The carrying strap of claim 1, wherein the carrying strap is transparent such that the carrying strap does not obscure a label of the container in the stowed position.

5. The carrying strap of claim 1, wherein the elongate web includes one of a surface design, coloring, logo, advertising information, graphic, Trademark, message, direction set, warning, ingredient list, game, bar code, Universal Product Code, Quick Response Code, and any combination thereof.

6. The carrying strap of claim 1, comprising a material selected from the group consisting of plastic, vinyl, metal, fabric, synthetic fiber, rubber, and any combination thereof.

7. The carrying strap of claim 1, wherein the securement aperture is a shape selected from a group consisting of a slit, an X-shape, an asterisk, an arcuate line, a C-shape, a circle with relief cuts, a triangle, and any combination thereof.

8. A container, comprising:

a body; and a carrying strap comprising:

an elongate web having a distal end and a proximal end;

a first attachment portion near the distal end and coupled to a first location on the body;

a second attachment portion located near the proximal end and removably coupled to a second location when the carrying strap is in a stowed position; and a securement aperture near the proximal end configured to receive a top portion of the body when the carrying strap is in a carrying position, wherein, in the stowed position, a first section of the elongate web near the distal end circumferentially wraps around the container continuously abutting the body and a second section of the elongate web near the proximal end circumferentially overlaps and abuts the first section, and wherein the second location is on the elongate web.

9. The container of claim 8, wherein the second attachment portion is removably coupled to the second location on the body when the carrying strap is in the stowed position using one of adhesive, interlocking features, and any combination thereof.

10. The container of claim 8, wherein the carrying strap is transparent such that the carrying strap does not obscure a label of the container in the stowed position.

11. The container of claim 8, wherein the elongate web includes one of a surface design, coloring, logo, advertising information, graphic, Trademark, message, direction set, warning, ingredient list, game, bar code, Universal Product Code, Quick Response Code, and any combination thereof.

12. The container of claim 8, wherein the carrying strap comprises a material selected from the group consisting of plastic, vinyl, metal, fabric, synthetic fiber, rubber, and any combination thereof.

13. The container of claim 8, wherein the securement aperture is a shape selected from a group consisting of a slit, an X-shape, an asterisk, an arcuate line, a C-shape, a circle with relief cuts, a triangle, and any combination thereof.

* * * * *